US008419504B2

(12) United States Patent
Junker

(10) Patent No.: US 8,419,504 B2
(45) Date of Patent: Apr. 16, 2013

(54) METHOD FOR RELIEF-GRINDING THE CUTTING TEETH OF TAPS, THREAD FORMERS, AND SIMILAR TOOLS

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 1139 days.

(21) Appl. No.: 12/224,731

(22) PCT Filed: Feb. 28, 2007

(86) PCT No.: PCT/EP2007/001728

§ 371 (c)(1),
(2), (4) Date: Nov. 6, 2008

(87) PCT Pub. No.: WO2007/101593

PCT Pub. Date: Sep. 13, 2007

(65) Prior Publication Data

US 2009/0104854 A1 Apr. 23, 2009

(30) Foreign Application Priority Data

Mar. 3, 2006 (DE) ..... 10 2006 009 986

(51) Int. Cl.
*B24B 1/00* (2006.01)
*B24B 49/00* (2012.01)
*B24B 51/00* (2006.01)

(52) U.S. Cl.
USPC ..... 451/5; 451/10; 451/13; 451/48

(58) Field of Classification Search ..... 451/5, 8, 451/10, 11, 13, 47, 48, 57
See application file for complete search history.

(56) References Cited

U.S. PATENT DOCUMENTS 1,874,626 A * 8/1932 Richer ..... 451/137
1,933,872 A * 11/1933 Olson ..... 451/137
2,479,281 A * 8/1949 Umbdenstock ..... 451/220
2,585,986 A * 2/1952 Andreasson ..... 451/220

(Continued)

FOREIGN PATENT DOCUMENTS

CH 413 637 5/1966
DE 1 577 395 2/1970

(Continued)

*Primary Examiner* — Timothy V Eley
(74) *Attorney, Agent, or Firm* — Jordan and Hamburg LLP

(57) ABSTRACT

In prior art, an additional radial inward movement that is performed in accordance with a rotating cam disk is imparted on the grinding disk in order to relief-grind the cutting teeth and the chamfer of taps and the cutting teeth of thread formers. The invention relates to a cam disk which can be rotated about an axis and is provided with a control cam. The control cam forms a group of curves according to a large number of possible undercut contours on the grinding teeth of the tap or thread former, which are to be relief-ground. In order to obtain a specific undercut contour on a cutting tooth, a limited angle of rotation is selected from the control cam. The area is mechanically, optically, or electronically scanned by means of a scanning device. To this avail, the cam disk performs an oscillating rotary movement only above the selected section of the control cam. Relief-grinding of the cutting tooth is completed once a fore-and-aft movement has been performed, and the grinding disk returns to the starting position thereof. The result of the scan is transmitted to an electronic control device via a signal line.

4 Claims, 3 Drawing Sheets

U.S. PATENT DOCUMENTS

| | | | | | |
|---|---|---|---|---|---|
| 2,787,868 | A | * | 4/1957 | Schifando | 451/48 |
| 3,267,616 | A | * | 8/1966 | Stahn et al. | 451/48 |
| 3,444,653 | A | | 5/1969 | Stade | |
| 3,905,156 | A | * | 9/1975 | Vogelsanger | 451/138 |
| 4,358,911 | A | | 11/1982 | Vogelsanger | |
| 5,127,776 | A | * | 7/1992 | Glimpel | 408/220 |

FOREIGN PATENT DOCUMENTS

| | | |
|---|---|---|
| DE | 26 31 283 | 4/1977 |
| DE | 29 52 610 | 7/1981 |
| DE | 41 30 736 | 3/1993 |

* cited by examiner

METHOD FOR RELIEF-GRINDING THE CUTTING TEETH OF TAPS, THREAD FORMERS, AND SIMILAR TOOLS

BACKGROUND OF THE INVENTION

The invention relates to a method for relief grinding the cutting teeth of taps, thread formers, and similar tools. The term "cutting tooth" shall also include the profile formers of thread formers.

The prior art includes such methods.

For instance, CH-PS 413 637 suggests a device suitable for this purpose in which a camshaft rotates continuously in the same direction. Two identically embodied cam disks with cams are provided on the camshaft. The cams for the two cam disks are offset from one another by 180 degrees. Positioned against each of the two cam disks is a scanning roller, these being coupled to one another via a parallelogram lever. The scanning movement for the scanning rollers is transmitted via another lever to an eccentric bearing for the grinding spindle. Depending on the position of the cams on the cam disks, the eccentric bearing of the grinding spindle is rotated so that a rotating grinding wheel is positioned with greater or less force against the tool to be ground. In this manner a relief is gradually created on a cutting tooth of the tool. One complete rotation of the camshaft and thus also of the cam disks corresponds to the grinding process on one cutting tooth. Provided for the transition to the next cutting tooth is a rapid return in which both scanning rollers temporarily lift from the cam disks.

Such direct mechanical scanning and transmission works relatively sluggishly. In addition, it is disadvantageous that the contour of the cam disks focuses on the undercut contour of a single cutting tooth. The cam disk must be exchanged if a tap, thread former, or similar tool is to be ground with a different undercut contour. However, cam disks are precision machine parts that must be machined with great accuracy and they are consequently expensive. Therefore, in addition to the time consumed for the required exchange of the cam disks, there is also the disadvantage that a large number of cam disks must be maintained in the inventory.

In order to alleviate this disadvantage, it has already been suggested in accordance with DE 29 52 610 C2 to provide, instead of a cam disk, a control roller, the surface of which has different profile depths along the roller axis. It should be possible to displace the control roller axially, even during the grinding process. In this manner it is possible to adjust the oscillation travel for a special relief grinding body that is also embodied adjustable as a part of the grinding table. The relief grinding body is positioned against the control roller by means of a scanning roller and is adjusted directly by this control roller. The relief grinding rate can be continuously adjusted when grinding with the grinding machine in accordance with DE 29 52 610 C2. However, in this case, as well, the drive shaft of the camshaft rotates continuously, and control roller must be exchangeable. A plurality of control cams can be embodied on the control roller, their teeth corresponding to the cutting teeth on the tool to be ground. However, for the grinding machine in accordance with DE 29 52 610 C2, for adapting to different required relief grinding shapes it is also expressly provided that different types of control rollers can be exchanged for one another. A special lifting device is provided for this. Also required is a gear unit with change gears that can be exchanged for one another as needed.

The machine in accordance with DE 29 52 610 C2 also suffers from the disadvantage of time-consuming dismantling and exchange processes in conjunction with maintaining an inventory of precision exchange parts.

Finally, known from DE 41 30 736 A1 is adjustably guiding a grinding spindle on a rotary table into two directions that are perpendicular to one another. For producing a relief on a securely clamped workpiece, the grinding spindle with a rotating grinding disk is forcibly guided by a guide rule. However, for producing different relief contours, in this case, as well, the guide rule must have different profiles, that is, it must be exchangeable.

SUMMARY OF THE INVENTION

In contrast, the underlying object of the invention is to improve the method known from the prior art such that low-inertia control is possible and such that it is possible to create different relief contours with different dimensions in a short machining time and without time-consuming exchange of precision control parts and without costly maintenance of inventory.

In contrast to the prior art, in which the cam disks or control rollers always rotate in the same direction, in accordance with the invention the control contour is scanned in a rotating oscillation movement. Scanning is provided for each cutting tooth using back and forth rotation across a limited circumferential angle of the control contour. Lifting of a scanning member and the associated risk of rattling or vibration is prevented using this oscillating scanning across only a limited segment of a smooth and continuous control contour.

Selecting the circumferential angle from the entire circumferential area of the control contour represents the first opportunity for establishing a specific relief or undercut contour for a cutting tooth. Another possible configuration is for the rotational speeds of the rotating scanning movement and the tool to be at a certain ratio to one another. For instance, a small circumferential segment of the control contour can be scanned slowly or a larger segment of the circumferential contour can be scanned at increased speed. Depending on this, another undercut contour is created on the cutting tooth, wherein the undercut contour can occur in one or more passes.

For further embodying this method it is advantageously provided that the rotational speeds of the rotating scanning movement and of the tool are operationally variable. Thus, the operator of a certain grinding machine can select a certain speed ratio prior to beginning the machining task and can set his machine accordingly, the speed ratio or the speeds being freely programmable. In this manner there are numerous possible variations for the undercut contour using a single control contour that is present in the machine.

The inventive method is further perfected in that in accordance with another embodiment the control contour of the rotation body includes the initial values for numerous possible undercut contours like a type of composite curve. Thus, for attaining a certain undercut contour it is only necessary to establish a certain circumferential segment of the control contour in which the scanning should take place. For each cutting tooth to be relief-ground then only one more rotating back and forth movement is required in just this selected segment of the control contour.

The disadvantages of exchanging and maintaining an inventory of exchange parts are thus finally eliminated.

There are a number of configuration options for the scanning movement in a rotating oscillation. For instance, the rotation body can stand still and be scanned using a light source that revolves around it or can be scanned magnetically on its circumference. One preferred embodiment is comprised in that the controlling rotation body is embodied as a rotating cam disk having a circumference like a type of control cam that acts as the control contour. Such a control cam is thus an extended control cam that has stored the different options for configuring the undercut contour (control curve). For attaining a certain undercut contour on a cutting tooth, a limited angle of rotation is selected from the control cam. This control cam can preferably be scanned mechanically, but fundamentally it can also be scanned optically and electronically. Control signals and/or adjusting forces obtained from the scanning movement then determine the mutual movement of the grinding wheel and the tool towards and away from one another in the direction in which the cutting tooth runs using the usual electronic evaluation and control device. However, direct mechanical transmission is preferred. In this manner the undercut contour of the cutting teeth is determined reliably, precisely, and rapidly.

The invention also relates to a grinding machine that is a type of universal circular/non-circular grinding machine for performing the method of the invention.

It is also essential for the grinding machine that a rotating cam disk is moved back and forth with its control cam across a selectable angle area by an oscillating rotational drive.

There are various options for the machine device for attaining the additional adjusting movement between the grinding wheel and the tool to be ground. This can involve the grinding spindle, its shaft, or another movable part on the grinding table, this additional part containing the clamping device for the tool to be relief-ground. What is always essential is agreement between a certain area of the control cam on the cam disk, the rotational speeds of the cam disk on the one hand and the tool on the other hand, with respect to the special undercut contour sought.

The invention is explained in greater detail in the following using an exemplary embodiment.

DETAILED DESCRIPTION OF THE INVENTION

Figure 1:
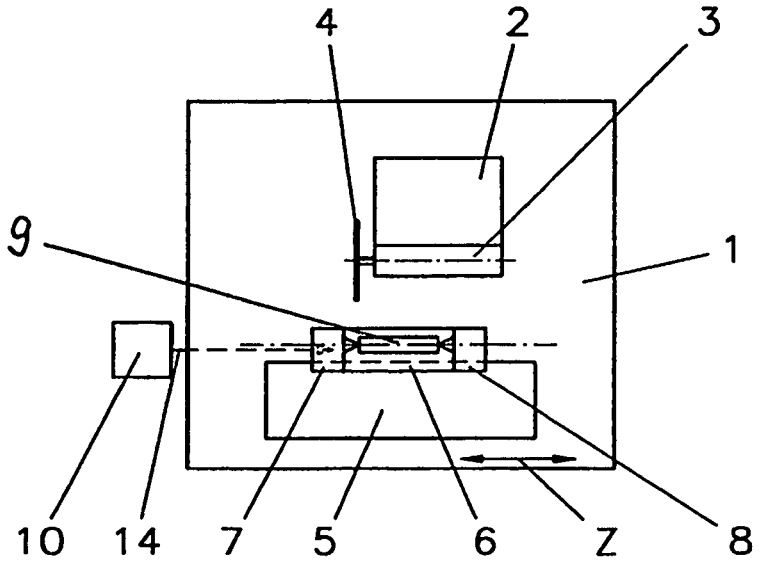
FIG. 1 is a view from above onto a grinding machine for performing the inventive method.

Provided on a machine bed 1 for the machine in accordance with FIG. 1 is a grinding headstock 2 that supports a grinding spindle 3 having a rotating grinding wheel 4. The grinding headstock 2 can also be pivotable about a vertical axis.

The machine bed 1 also bears a grinding table 5 that can be adjusted—as is usual—in its longitudinal direction (Z axis). Disposed on the grinding table 5 is a movable support part 6 that can be adjusted on the grinding table 5 perpendicular to the axis Z, that is, in the direction of the usual X axis. The support part 6 carries the workpiece headstock 7 and the tailstock 8, between which for instance a tap or similar tool 9 is clamped. The tool 9, which is created here, is also the workpiece in this case. The tool 9 thus also runs in the Z axis and is simultaneously rotated in a controlled manner about its longitudinal axis, the usual C axis.

Figure 3:
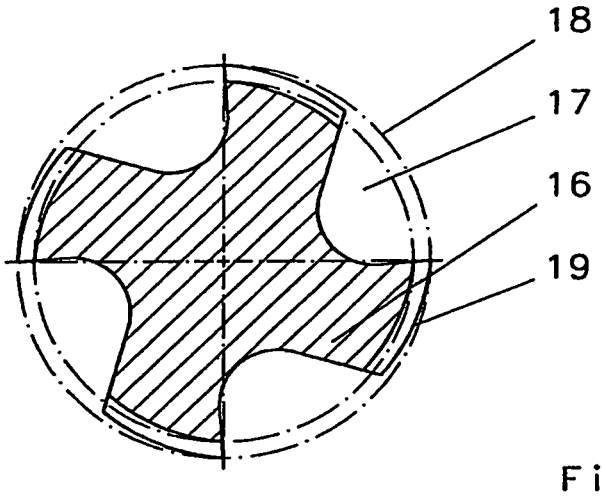
FIG. 3 explains the connection between the number of cutting teeth and the grooves on a tap drill.

In the exemplary embodiment depicted, the plane of rotation for the grinding wheel 4 is exactly perpendicular to the longitudinal axis of the tool 9. However, this does not have to be the case; the option, cited in the foregoing, of rotating the grinding headstock 2 about a vertical axis, also permits the grinding wheel 4 to be positioned obliquely against the tool 9. Conversely, the grinding table could also be placed obliquely to the axis of the grinding spindle 3. In each case the grinding wheel runs, relative to the tool, in the direction in which the cutting teeth 16 and grooves 17 being created run (FIG. 3).

The rotational movements of the tool 4 and the grinding wheel 9, and the positioning movement of the grinding wheel 4 relative to the tool 9 are coordinated with one another using an electronic control device 10 so that the desired movement occurs in the direction in which the grooves 17 and cutting teeth 16 run.

Figure 2:
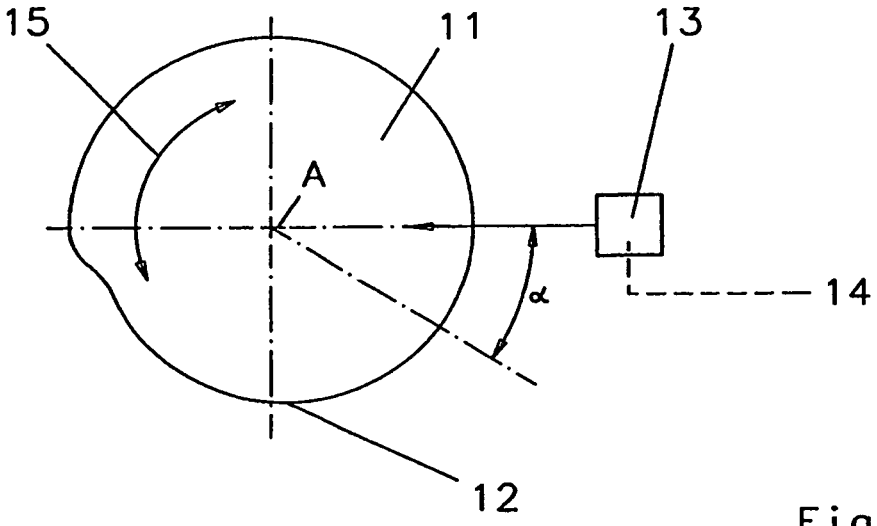
FIG. 2 depicts the scanning principle as embodied in the invention.

FIG. 2 explains the principle of the control. A cam disk 11 having a control cam 12 is provided that is rotatably borne and that is offset in a rotating oscillation movement by a low-inertia, high-precision drive. The oscillation occurs via a freely selectable larger or smaller angle of rotation, which is labeled a in FIG. 2. Analogous to the usual axis labels during the grinding process, the rotational axis of the cam disk 11 is labeled A. The contour of the control cam 12 is scanned by a scanning device 13 that can work mechanically, optically, or electronically and that transmits the scanning signal obtained via a signal line 14 to the aforesaid electronic control device 10. Alternative to the depiction in accordance with FIG. 2, however, direct mechanical transmission of the contour of the control cam 12 to the positioning movement of the grinding wheel is particularly advantageous.

The alternating rotational direction of the grinding wheel 11 is identified with the rotational direction arrow 15.

When the cutting teeth 16 are to be relief ground on a certain tap, thread former, or similar tool 9, first a certain angle segment $\alpha$ that best corresponds to the desired undercut contour of the cutting tooth 16 is sought from the control cam 12. The cutting teeth 16 are then relief-ground synchronously with the scanning of the selected angle area $\alpha$ on the control cam 12. Another configuration option is comprised in that the scanning can occur at a different speed. For instance, a highly changing undercut contour can be attained in that a larger angle area $\alpha$ is scanned at a higher speed; likewise, a "quieter" course for the undercut contour can be attained in that a smaller segment is traveled slowly. If the grinding wheel 4 reaches the end of the cutting tooth 16 and passes into the groove 17 between the cutting teeth 16, the scanning of the angle area $\alpha$ is also concluded; the initial position for tool 9 and grinding wheel 4 is recovered and the cam disk 11 changes its rotational direction and also returns to its initial position. The process is repeated for the next cutting tooth 16.

The relative positions on the cross-section of a tap are depicted in FIG. 3 to facilitate understanding. The cutting teeth 16 alternate with grooves 17, and the undercut is comprised in that the backs of the cutting teeth 16 move inward from an enveloping circular contour 18. Numerous variations are possible for the course of the tooth back 19, that is the undercut contour.

The invention claimed is:

1. Method of forming a relief in relief grinding cutting teeth of a workpiece including a tap drill and/or a thread former, comprising:

rotating the workpiece in which the teeth are to be relief ground, guiding a rotating grinding wheel in a direction of orientation of the teeth to be relief ground, and effecting a positioning relative movement of the rotating grinding wheel in a direction radially inward with respect to a longitudinal axis of the workpiece;

superimposing an additional radially inward movement of the grinding wheel to produce the relief; and controlling the additional inward movement by a rotation body that has a control contour in a circumferential area thereof that determines the contour of the relief;

wherein a rotating scanning movement of the control contour effects a controlled relative movement of the grinding wheel and the workpiece toward and away from one another to produce a predetermined relief contour on the cutting teeth;

the rotating scanning movement is an oscillation movement of the rotation body, an oscillation cycle including a back and forth rotation of the rotation body occurring for each cutting tooth across a predetermined circumferential angle of the control contour;

the control contour of the rotation body comprises initial values for a plurality of relief contours of a cutting tooth to be ground, at least one of the contours being a composite curve; and selection of the circumferential angle from the entire circumferential area of the control contour, together with speeds for the scanning movement and the workpiece rotation, determine the relief contour of the cutting teeth.

2. Method in accordance with claim 1, wherein:

the controlling rotation body is a rotating cam disk;

the scanning movement is effected mechanically; and the scanning movement effects control signals and/or adjusting forces calculated by an electronic control device for controlling the relative movement of the grinding wheel and the tool towards and away from one another for obtaining the relief contour of the cutting teeth.

3. Method in accordance with claim 1, wherein a contour of the grinding wheel is adapted to a contour of a chamfer of a respective tap drill and a circumferential area of the control contour corresponds to the relief-ground contour of the cutting teeth in the chamfer.

4. Method according to claim 1, wherein the control contour comprises a composite curve.

* * * * *